US011471935B2

(12) United States Patent
Han

(10) Patent No.: US 11,471,935 B2
(45) Date of Patent: Oct. 18, 2022

(54) METHOD OF PRODUCING HIGH QUALITY METALLURGICAL BOND WITHIN A COMPOSITE CASTING

(71) Applicant: Qingyou Han, West Lafayette, IN (US)

(72) Inventor: Qingyou Han, West Lafayette, IN (US)

( * ) Notice: Subject to any disclaimer, the term of this patent is extended or adjusted under 35 U.S.C. 154(b) by 183 days.

(21) Appl. No.: 16/919,054

(22) Filed: Jul. 1, 2020

(65) Prior Publication Data

US 2022/0001441 A1 Jan. 6, 2022

(51) Int. Cl.

| | |
|---|---|
| ***B22D 11/115*** | (2006.01) |
| ***B22D 19/02*** | (2006.01) |
| ***B22D 27/02*** | (2006.01) |
| ***B22D 27/04*** | (2006.01) |
| ***C22C 21/02*** | (2006.01) |
| ***C22C 23/02*** | (2006.01) |
| *B22D 21/04* | (2006.01) |

(52) U.S. Cl.

CPC ..... *B22D 11/115* (2013.01); *C22C 21/02* (2013.01); *C22C 23/02* (2013.01); *B22D 21/04* (2013.01)

(58) Field of Classification Search

CPC .. B22D 11/115; B22D 19/00; B22D 19/0009; B22D 19/02; B22D 21/04; B22D 27/02; B22D 27/04; B22D 27/08; C22C 21/02; C22C 23/02

USPC .... 164/466, 467, 468, 147.1, 502, 503, 504, 164/122, 122.1

See application file for complete search history.

(56) References Cited

FOREIGN PATENT DOCUMENTS

CN 110640116 A * 1/2020 ..... B22D 19/02

OTHER PUBLICATIONS

Machine translation of CN 110640116 A (Year: 2020).*

* cited by examiner

*Primary Examiner* — Kevin P Kerns

(57) ABSTRACT

A method of forming high quality metallurgical bonds in a composite casting is provided. The bonding technology includes the step of introducing a liquid material to contact the solid components placed in a mold cavity, applying an external field to generate stifling near the solid/liquid interface to wash off bubbles and oxide particles that prevent the liquid material from reacting to the solid component, and causing progressive solidification from the surfaces of the solid component to the liquid to drive away bubbles in the mushy zone near the bonding region. High quality metallurgical bonds are formed within the composite casting after the liquid solidifies. The resultant large composite casting has minimal defects, such as pores and oxides, at the interfaces between the solidified material and the solid objects.

16 Claims, 13 Drawing Sheets

METHOD OF PRODUCING HIGH QUALITY METALLURGICAL BOND WITHIN A COMPOSITE CASTING

GRANT STATEMENT

This invention was made in part from SBIR funding by National Science Foundation and the U.S. Government has certain rights to the invention.

FIELD OF THE INVENTION

The present invention relates to the casting of metals, more specifically, to the production of a high-quality metallurgical bond within a composite casting using a novel cast-on method.

BACKGROUND OF THE INVENTION

This invention relates generally to the joining of a number of similar or dissimilar solid objects (inserts, forgings, castings or other forms of components) by pouring a liquid metal to form a large composite casting. It is difficult to make a composite casting consisting of similar or dissimilar materials bonded with a high-quality metallurgical bond.

The size of a large and thin-walled casting is limited by the fluidity of the alloy, and the forces that a casting machine can handle [1]. High quality complex castings with a large variation in wall thickness are usually difficult to make due to the formation of defects such as shrinkage porosity and hot tears. Often. parts have to be mechanically fastened or joined to form a large component.

For example, welding is one of the common methods used for joining two smaller parts to form a larger part. However, this method is limited by the weldability and thickness of the materials. Generally, any casting method that is suitable for joining a number of similar or dissimilar components in-situ in a mold cavity is much more cost effective than other manufacturing methods.

Lightweight metals and alloys such as aluminum and magnesium have found increased applications in replacing iron and steels in automotive industries for weight reduction of the vehicles. Such substitutions, however, have often resulted in compromised performance and/or reliability. A well-known solution to some of the performance and reliability problems associated with the use of lightweight casting materials as a substitute for cast irons and steels has been to provide high strength inserts at critical locations where severe wear or high stress is known to occur. Critical locations are defined as areas in a casting where the stresses, wear, or temperatures exceed the capabilities of the lightweight materials. Inserts of expensive material can also be used at critical areas where severe corrosion is known to occur so that inexpensive material can be used for making the rest part of a component or a casting.

The concept of joining similar materials or dissimilar materials into a single component using a casting method is not new [2-4]. Over the years it has been referred to as bimetal or bimetallic construction, composite design, duplex materials, and others [5-7]. Cast-on method is one of the most cost-effective methods for joining irons or steels to low melting temperature metals using a metal casting process [2-7]. This method has found some applications but has not gained general acceptance in applications of high performance, reliability, and durability requirements. One explanation for this is the difficulty in achieving an effective and durable metallurgical bond between the insert and the adjacent casting material.

Beile and Lund [7] disclose a technology for achieving metallurgical bonding requiring an absolutely clean surface on the inserts. Practical methods to prevent oxidation are to employ vacuum, and to use atmospheres such as reducing atmospheres. It has been reported that the production of an intimate bond may be prevented by the presence of an oxide film on the outer surface of the aluminized coating on the insert [8].

U.S. Pat. No. 5,005,469 to Ohta, and U.S. Pat. No. 6,443,211 to Jorstad et al. disclose improved approaches to achieve acceptable metallurgical bond between inserts and the cast metal. These approaches utilize pre-coating to protect the insert surface from oxidation and other contaminations. However, none of these methods have been entirely successful in producing consistent, high strength bonds between inserts and casting materials that will meet the long term demands for reliability required in certain applications such as the manufacture of heavy-duty diesel engine components. These methods are still prone to producing defects caused by voids or air gap, gas porosity, and oxides. In many cases, the inserts just simply drop off the castings as the number of defects is so great that no metallurgical bonds are formed whatever.

Another approach toward achieving an acceptably strong bond between inserts and lightweight cast metal is disclosed in U.S. Pat. Nos. 6,443,211 and 6,484,790 [11] to Myers et al. It is a cast-on method in which the insert is coated with two layers before is placed in the mold cavity for making a composite casting. The first layer of coating is designed to serve as a diffusion barrier between the insert and the cast material and the second layer of coating is sacrificial coating that dissolves into the cast material during the casting process. The molten casting material is treated and handled to keep the hydrogen content low, and the pouring of the molten metal takes place under a protective atmosphere [9]. The cost of this approach is usually high. Still, defects, such as gas porosity, air pockets, and oxides, form at the interface between the reinforcement inserts and the casting.

It is an objective of this invention to provide a method for making a high-quality metallurgical bond between a casting and its reinforcement solid insert or component of similar or dissimilar materials using the cast-on method. Here the metallurgical bond is defined as a bond formed due to chemical reactions between the solid insert or component and the liquid material cast on it.

Another objective of this invention is to provide an improved cast-on method that can be used to form an intimate bond between a solid insert to the casting in case that there is no chemical reaction between the solid components and the cast liquid material.

A further objective of the invention is to provide an improved cast-on method that reduces or eliminates gas porosity and oxides on the bond or in the regions near the bond, forming a strong composite casting after the liquid material is solidified.

A yet further objective of this invention is to provide an effective method of producing fine and modified solidification microstructure in the casting adjacent to the metallurgical bond, strengthening the composite casting containing inserts of similar or dissimilar materials.

SUMMARY OF THE INVENTION

In an exemplary embodiment of the present invention, a process of producing a high quality metallurgical bond between a solid insert and a freezable metallic material using a cast-on method is provided. The process includes the steps of preparing at least one solid insert or component made of similar or dissimilar material to the cast material, placing at least one solid insert in the mold cavity, introducing a freezable liquid material to fill the mold cavity and contact the solid inserts at the interfaces between the solid insert and the liquid material, applying external fields to generate local stirring in the liquid near the said interfaces, maintaining a local progress solidification from the surfaces of the solid inserts, and solidifying the entire liquid material to form a composite casting containing the inserts.

In another exemplary embodiment of the present invention, a process of reducing defects in metallurgical bond between a solid insert and a freezable metallic material using a cast-on method is provided. The process includes the steps of introducing a freezable liquid material to fill the mold cavity and contact the solid inserts at the interfaces between the solid insert and the liquid material; and applying external fields to generate local stirring in the liquid near the said interfaces to wash off or shake off the gas bubbles and oxide films that usually attach to the surfaces of the solid components, to clean the surfaces of the solid components that are in contact with the molten material, and to promote chemical reaction between the molten material and the solid components. The external fields include static, alternating, or pulsed fields of electric, magnetic, electromagnetic, acoustic, and mechanical, and other forms of low magnitude vibrations.

In another exemplary embodiment of the present invention, a process of producing fine and modified solidification microstructure in the casting adjacent to the metallurgical bond between solid insert and a freezable metallic material using a cast-on method is provided. The process includes the steps of introducing a freezable liquid material to fill the mold cavity and contact the solid inserts at the interfaces between the solid insert and the liquid material; and applying the said external fields to enhance nucleation of solid phases and to break up dendrites into non-dendritic grains in the solidifying casting adjacent to the said metallurgical bond.

In another exemplary embodiment of the present invention, a process of using local progressive solidification under the influence of external fields to drive bubble away from the bonding regions in the solidifying casting is provided. The process includes the steps of introducing a freezable liquid material to fill the mold cavity and contact the solid inserts at the interfaces between the solid insert and the liquid material; and using external cooling on the solid components to cause progressive solidification from the surfaces of the solid components to the adjacent molten material under the influence of external fields, driving bubbles that exist in the mushy zone away from the surfaces of the solid components. The mushy zone is defined as the region in the casting which contains at least two phases: one liquid phase, one or more solid phases, and sometimes a gas phase that forms the bubbles.

In yet another embodiment, the invention relates to a method of bonding of solid components of similar or dissimilar materials to a freezable material is provided. The invention also includes the steps of applying external fields through the solid components to the solidifying casting and using external cooling on the solid components to cause progressive solidification from the surfaces of the solid components to the adjacent molten material, driving bubbles that exist in the mushy zone away from the surfaces of the solid components. After the liquid material is solidified, another layer of liquid material can be bonded to the solidified part for forming multilayered structures consisting of similar or dissimilar materials.

The invention provides a cost-effective method for producing high quality metallurgical bonds between smaller solid components and a freezable material to form a large composite casting.

The invention also provides a method capable of producing a multi-functional composite solid article which is stronger and larger than those produced using conventional casting technologies.

DETAILED DESCRIPTION OF THE INVENTION

Figure 1:
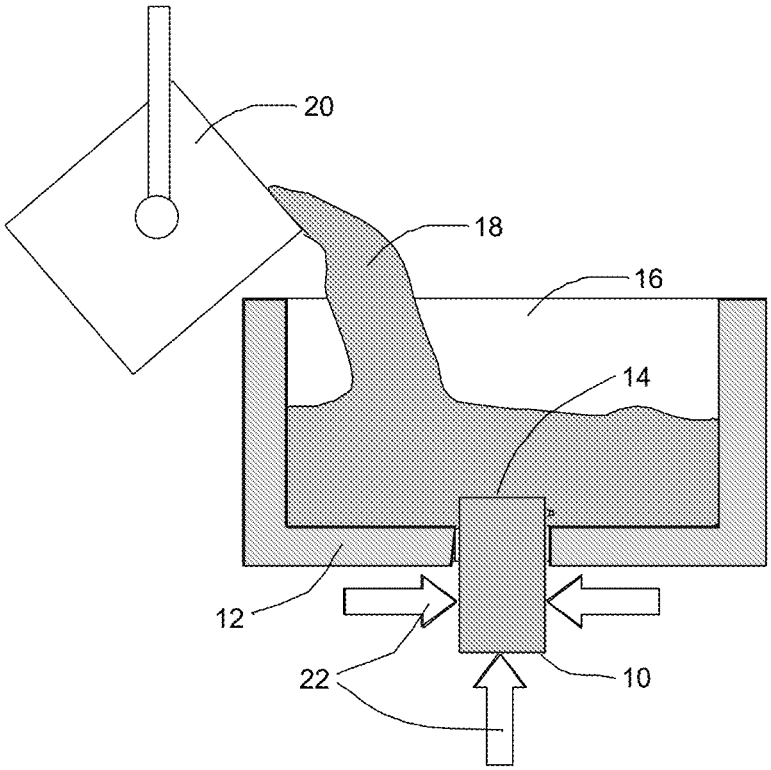
FIG. 1 is a schematic representation of a modified cast-on method for bonding one solid component to a freezable liquid material in accordance with this invention.

Unless otherwise defined, all technical and scientific terms used herein have the same meaning as commonly understood by one of ordinary skill in the art to which this invention belongs. All publications, patent applications, patents, and other references mentioned herein are incorporated by reference in their entirety.

In the preferred embodiment, the present invention deals with a method of bonding a solid component or a number of solid components using a freezable metallic liquid material to produce a larger composite solid article. The materials for the solid component can be aluminum alloys, magnesium alloys, steels, cast irons, titanium alloys, and other metallic materials which either can react chemically or are dissolvable to the liquid freezable material. The solid components can also consist of any solid materials, including ceramics, which are cladded or plated with a layer of material which either reacts chemically with or is dissolvable to the freezable liquid material. The liquid material is usually a metallic material but can be any other material as commonly understood by one of ordinary skill in the art to which this invention belongs. The liquid material solidifies on the solid materials to form a solid article. The liquid material can also be a semi-solid material.

The solid component is contacted with the liquid at its surfaces within a mold cavity before solidification takes place in the liquid material. The surfaces can be flat, curved, random, or any other type of morphology.

Any method suitable for producing the desired article can be used for contacting the solid components with the liquid material. The solid components, the liquid material, or both the solid and liquid can be stationary, rotation, or moving. In a preferred method, the solid components consist of previously formed parts which are placed partially inside a mold cavity. The liquid material is introduced into the mold cavity using any method so that the liquid material contacts the surfaces of the solid component.

In other methods, the contacting process of the solid components with the liquid material involves forming a layer of the liquid material or semi-solid material over a previously formed solid component. One or more additional layers of liquid or semi-solid material can be formed and bonded to each preceding layer by the method of this invention. The method of this invention enables the production of multilayered structures with greatly improved delamination resistance. Contacting processes include but are not limited to 3D laser printing, spray forming, and etc.

A liquid material reactive to the solids is bound to react with the solids at their interfaces if the liquid metal is allowed an intimate contact to the solids. Interfacial defects at the bonding region relate to the existence of bubbles/voids, oxide films or particles, and inclusions on or near the interface. These substances that attach to the surfaces of the solid become physical barriers that prevent an intimate contact between the liquid and solid materials. Without an intimate contact of the liquid material to the surfaces of the solid component, chemical reactions between the solid and liquid material cannot occur. However, metallurgical bonds must come from chemical reactions between these two materials. Natural convections in the liquid during mold filling are usually insufficient to remove these substances off the interfaces, resulting in a defective bond between the solid components and the solidified liquid material [9].

This invention teaches to use forced stirring in the liquid metal adjacent to the surface of the said interfaces to shake off bubbles and oxide films that usually attach to the surfaces of the components submerged in a liquid material. Such forced stirring has to be induced using an external field which is generated outside of the casting. The external field can be a static, alternating, or pulsed field such as electric, magnetic, electromagnetic Lorentz forces, mechanical forces, electromagnetic vibration, acoustic, and other low magnitude vibrations. The external field can also be a combination of the fields aforementioned. Stirring that is generated using an external field is capable of not only shaking off or removing bubbles and particles that are attached to the surfaces of the solid material but also cleaning the surfaces of the solid components, allowing chemical reactions to occur between the solid and liquid materials. Metallurgical bonds at the interfaces result from such chemical reactions. With the metallurgical bond formed, the solidification process should be controlled such that a local progressive solidification from the solid materials to the liquid casting is maintained in order to drive bubbles away from the interfaces between the solid components and the liquid material [10]. Alternating external fields enhance the removal of bubbles away from the mushy zone. The local progressive solidification can be achieved by applying external cooling to the outer side surfaces of the solid material to extract heat from the liquid material in the mold cavity.

Another objective of using the said external fields is to modify the morphologies and to reduce the sizes of the solid phases precipitated from the liquid material during its solidification [11]. The primary dendritic phase is modified and the dendritic grain size is significantly reduced [12-15]. The eutectic phases are also modified and the sizes of the eutectic particles are greatly reduced [15-17]. Castings of modified morphology and reduced size of solidification microstructure are stronger and tougher than those of unmodified and coarse microstructure.

FIG. 1 illustrates a preferred cast-on method of this invention. In this method, a solid component 10 is positioned in the mold 12. Part of the surfaces 14 of the solid component 10 is in the cavity 16 of the mold 12. The molten material or liquid material 18 is poured from a ladle 20 into the cavity 16. Before or immediately after the liquid material 18 contacts the solid component 10 at the interface 14, external fields 22 are applied through the solid component 10 to the liquid 18, generating stirring in the liquid 18 near the interface 14. The stirring thus generated should be strong enough to drive off bubbles and oxide particles that attach to the interface 14, and to make the interface 14 clean enough so that the liquid material 18 can readily react with the solid component 10 to form a metallurgical bond at the interfaces 14. The external fields 22 applied through the solid component 10 to the liquid 18 also enhance the chemical reactions between the liquid material 18 and the solid component 10 at their interfaces interface 14. If necessary, artificial cooling can be applied on the surfaces of the solid component 10 outside the mold 12, to the liquid materials 18 to ensure that the solidification progresses from the solid component 10 to the liquid casting 18. One application of this method is the reinforcement of aluminum engine head with dissimilar metals such as steels or cast irons. Steel or cast iron inserts in this case are the solid component 10 and an aluminum alloy is the liquid material 18. The solid inserts can be placed in the engine head where stresses and temperatures are high. The composite aluminum engine head thus formed can be used to replace much heavier cast iron engine heads for a diesel engine or a gasoline engine with high energy density requirements.

Figure 2:
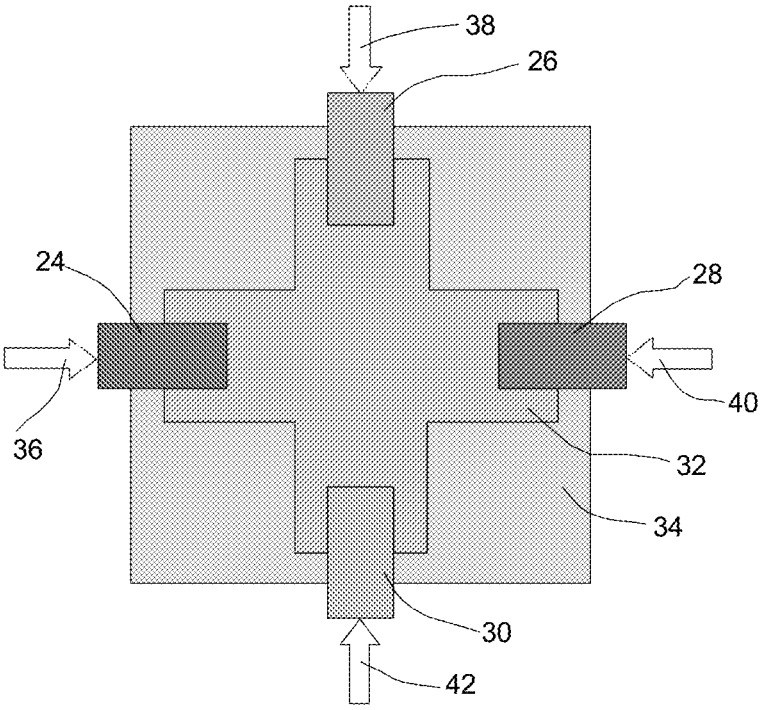
FIG. 2 is a schematic illustration of a modified cast-on method for bonding a number of solid components to a freezable liquid material in accordance with this invention.

The method shown in FIG. 1 can be extended to produce a multi-functional composite casting containing a number of solid components or inserts; each has similar or dissimilar mechanical or physical properties to that of the liquid material. In another embodiment, the present invention relates to a method of bonding a first solidifiable liquid material to solid components to produce a composite solid article. FIG. 2 illustrates four solid components, 24, 26, 28, and 30, respectively, placed in a mold 34. A liquid material 32 can be poured into the cavity of the mold 34 to bond these four inserts. External fields, 36, 38, 40, and 42, are applied on the solid parts to bond these solid parts to the liquid casting 32. An integral solid article is then made after the liquid material 32 solidifies in the mold 34, forming a composite solid article which contains inserts 24, 26, 28, and 30 of similar or dissimilar materials to the casting 32 at designed locations.

Figure 3:
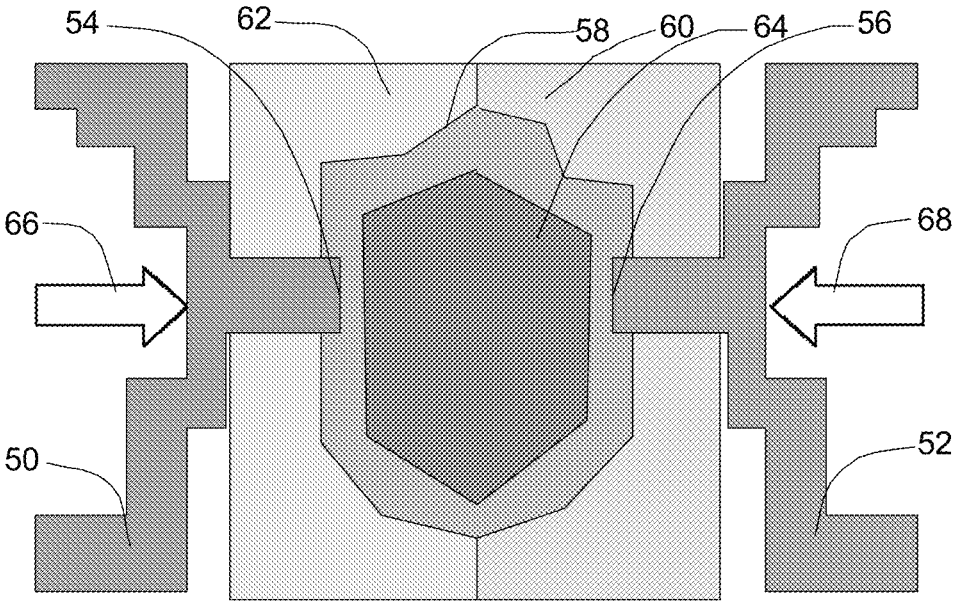
FIG. 3 is a schematic illustration of a modified cast-on method for bonding two solid components of complex geometry to a freezable liquid material in accordance with this invention.

The solid components shown in FIG. 2 can be of complicated shapes. In another embodiment, the present invention relates to a method of bonding a freezable material to a number of solid articles with complex geometries to produce a much larger and complex solid composite component than the individual solid article. The idea is illustrated FIG. 3, where both solid components, 50 and 52, are of complex geometry made using any manufacturing process. A liquid material 58 is cast into a cavity formed by a core 64 and two molds 60 and 62. External fields, 66 and 68, are applied on the solid components 50 and 52, respectively, shaking off bubbles and oxide films that tend to attach on the interfaces 54 and 56 and encouraging chemical reactions between the liquid metal 58 and the solid components 50 and 52 at the interfaces 54 and 56. After the liquid material 58 solidifies in the cavity of molds 60 and 62, a composite solid article, consisting of the casting 58, solid #1 50, and solid #2 52, is much larger than each of the individual solid components. The high quality metallurgical bond formed between the liquid material 58 and each of the solid components 50 or 52 ensures that the resulting solid composite article has excellent mechanical properties. Using the method shown in FIG. 3, large and complex castings can be made. Such large and strong castings are usually not castable using conventional casting methods.

Figure 4:
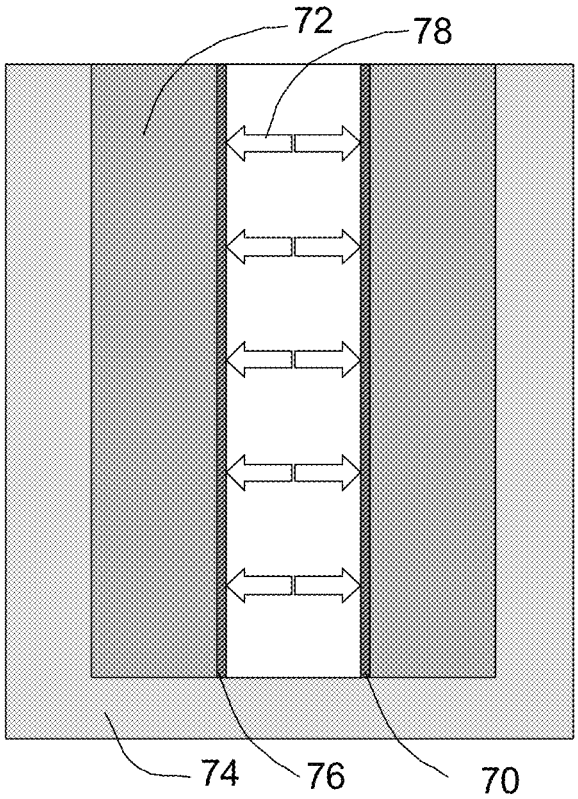
FIG. 4 is a schematic illustration of a modified cast-on method for bonding a thin liner to a freezable liquid material in accordance with this invention.

FIG. 4 illustrates another preferred method of this invention. In this method, a thin liner 70 is used as one side or a portion of one side wall of a cavity in mold 74. The molten material 72 is poured into the cavity defined by the mold 74 and the liner 70 76. External fields 78 are applied upon the liner 70 so that the liner material 70 reacts to the liquid material 72 at their interface 76 to form a metallurgical bond between them. The external fields 78 also affect the microstructure formed during the solidification of the molten material 72. External cooling can be applied on the liner 70 to drive bubbles away. The applications of this preferred method include washers on a casting for fastening, cylindrical liners in an engine block, and etc.

The present invention provides many advantages over prior arts [2-9]. The advantages include 1) low costs because no coating and nor surface cleaning using acids and bases are required, 2) improved bonding strength because of minimized defects in the bonding region, and 3) enhanced physical properties and mechanical properties because of the modified solidification microstructure and improved bonding quality in the composite casting.

The conventional cast-on methods [2-9] are known to produce defective bonds between the freezable liquid material and the solid inserts or components. Coatings on the solid surfaces have been suggested to improve the quality of the metallurgical bond but with limited success. Furthermore, the use of coatings increases the production costs. Still, oxides and voids in the molten metal tend to adhere to the solid-liquid interfaces during mold filling, leading to the formation of a defective bond. Bubbles tends to travel to the hot spots in a casting [10], increasing porosity defects near the bond if the insert happens to locate in the hot spot.

Figure 5A:
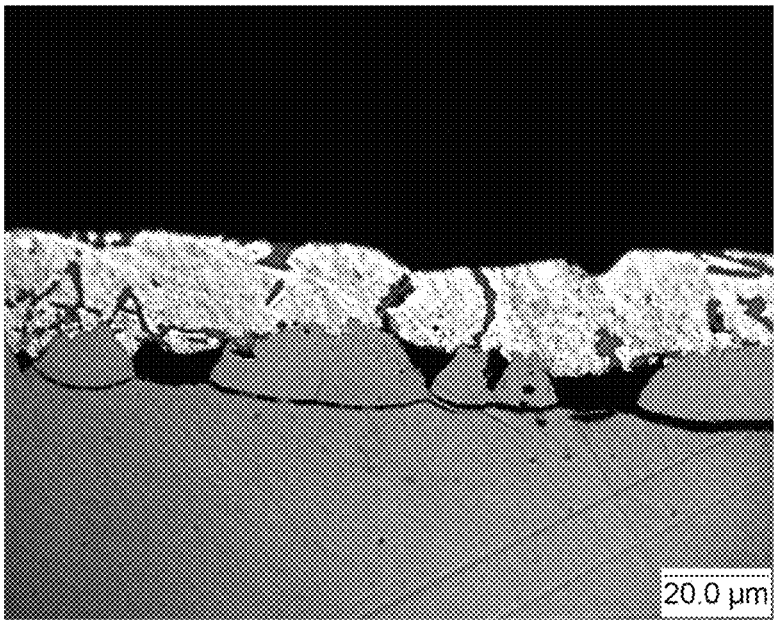
FIG. 5A is a micrograph of a defective bond between steel insert and aluminum.
Figure 5B:
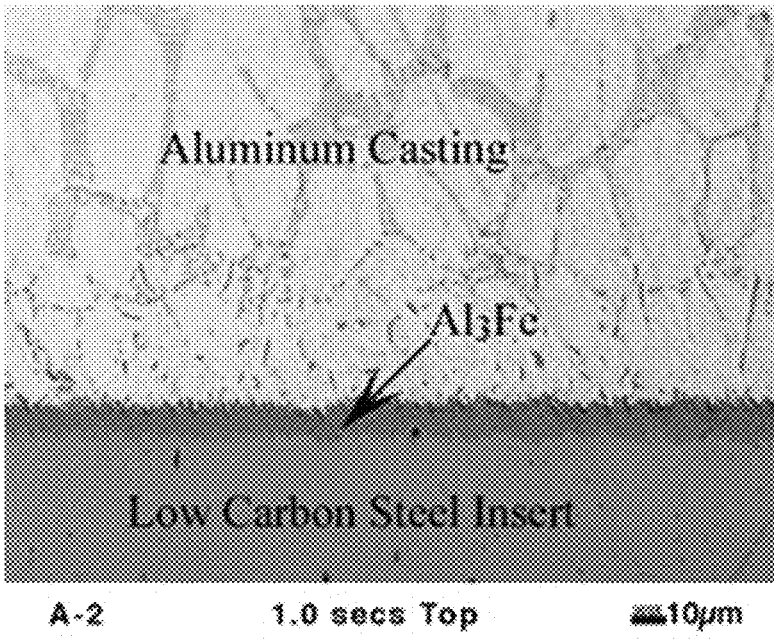
FIG. 5B is a micrograph of a perfect metallurgical bond.

The new bonding method of this invention teaches the use of external fields to drive bubbles and oxides away from the surfaces of the solid materials during mold filling, allowing the cleaned surfaces of the solid components to contact and react with the liquid material cast on them. FIG. 5A shows a defective bond between steel insert and aluminum. The steel insert was submerged into the molten aluminum for 1 minute before the molten metal solidified on the insert. Voids and oxides are found at the interface between the steel and aluminum. The voids were formed by bubbles that attached to the interface when the steel insert was submerged in the molten metal. FIG. 5B shows a perfect metallurgical bond between aluminum alloy and steel. Strong external stirring was introduced to the interface to shake/wash off bubbles and oxides that attached to the interface, allowing an intimate contact of the molten metal to the steel. The chemical reactions between aluminum and steel resulted in a perfect metallurgical bond consisting of iron-aluminides. No voids and oxide particles are found at the interface shown in FIG. 5B.

Figure 6:
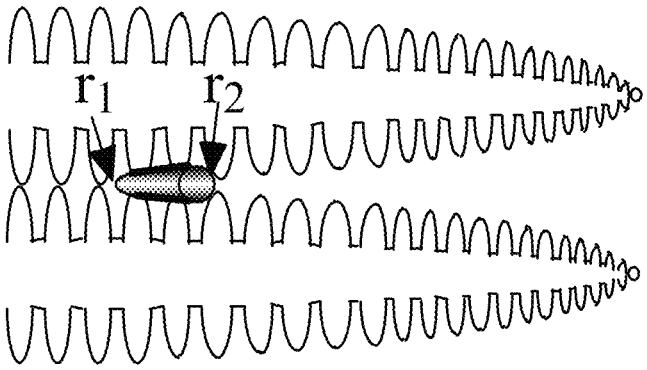
FIG. 6 is a schematic illustration of the shape of a bubble in a dendritic array of two dendrites.

In case the bond is located in the hot spot in a casting, the invention also teaches to cause progressive solidification from the solid components to the liquid to drive bubbles away from the solid/liquid interface, which is the location where the metallurgical bond is formed. External cooling has to be applied to produce progressive solidification from the solid components to the hot liquid. This is because bubbles tend to travel to the hotter regions in the mushy zone due to a pressure gradient over the bubble. Furthermore, the shrink of dendrites (solid structure) squeezes the bubble to regions where the fraction of liquid is higher. As a result, bubbles are usually collected at the solid/liquid interface if the interface is located in the hot spot in the mushy zone. The mechanism by which bubbles are driven to the hot spot is illustrated in FIG. 6. A bubble entrapped in the mushy zone would have larger curvature (smaller radius) at its lower temperature side than that at its higher temperature side. Assuming the curvatures at both sides are $1/r_1$ and $1/r_2$, respectively, as illustrated in FIG. 6, the pressure applied at both sides is given by $P_1=2d/r_1$ and $P_2=2d/r_2$, respectively. The pressure difference resulting from the curvature difference at both sides of the bubble would give rise to a force that pushes the bubble to the region of higher fraction of liquid in the mushy zone. Progressive solidification from the surface of the solid insert to the liquid material would drive bubbles away from the solid/liquid interface. Forces arising from external field would add to the pressure force in driving the bubbles away from the solid material, making the material near the bond denser and stronger. An oscillating field is more effective in driving bubbles off the mushy zone than a static field.

The invention further provides examples of producing high quality metallurgical bonds using a cast-on method. The examples provided below are meant merely to exemplify several embodiments, and should not be interpreted as limiting the scope of the claims, which are delimited only by the specification.

Example 1

Figure 7:
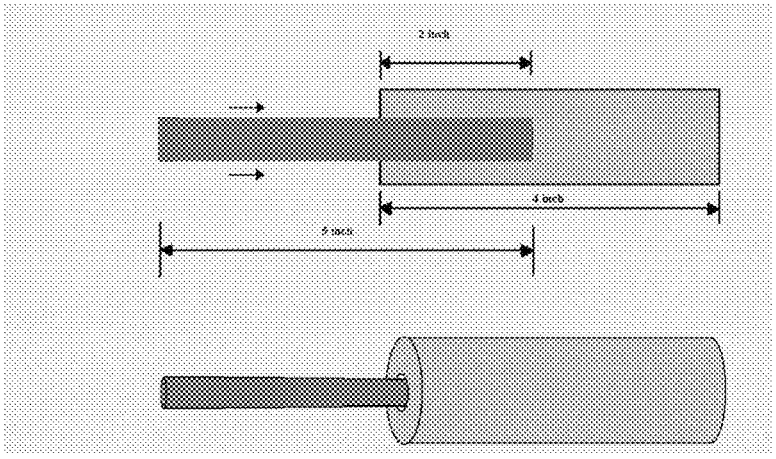
FIG. 7 is schematic illustration of the dimensions of a composite casting.
Figure 8:
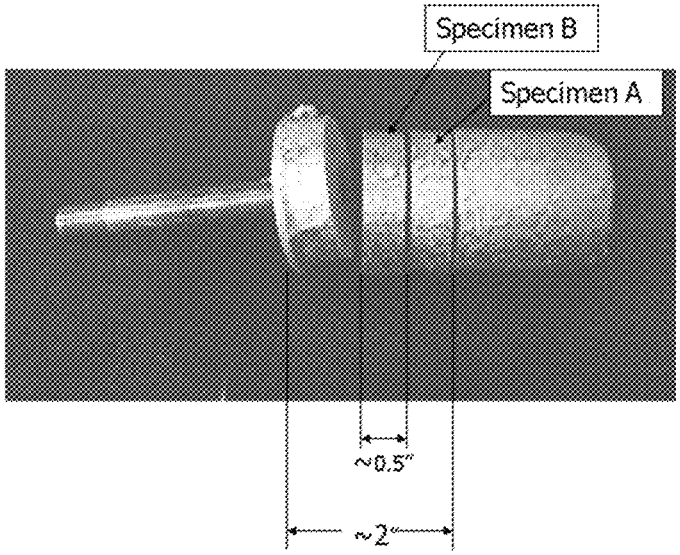
FIG. 8 is photograph of a composite casting with specimens cut for characterization of their microstructure and mechanical properties.
Figure 9A:
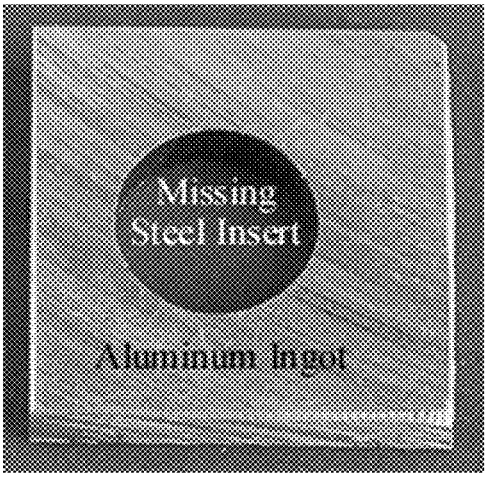
FIG. 9A shows the missing insert in aluminum.
Figure 9B:
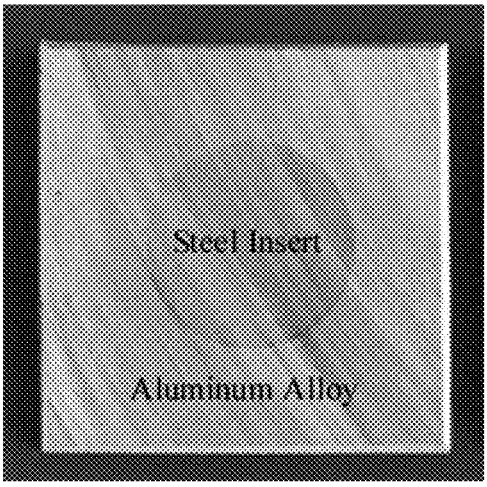
FIG. 9B shows the as-cut surface of the specimen.
Figure 9C:
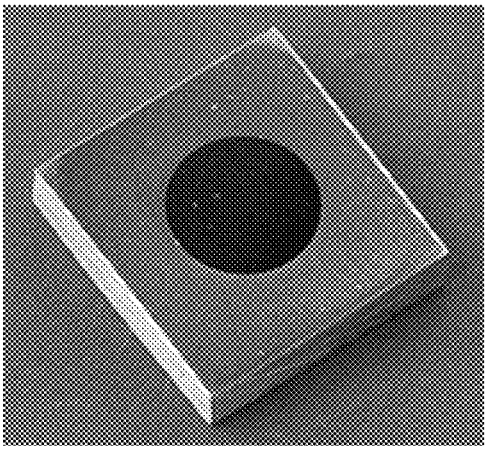
FIG. 9C shows the polished surface of a specimen.

This example was designed to demonstrate that the approach shown in FIG. 1 of this invention is capable of producing high quality metallurgical bonds between the steel insert and the aluminum casting. Aluminum A354 alloy was chosen for demonstrating the advantages of this invention. The liquidus of the alloy is 596° C. The alloy was then heated to temperatures above its liquidus to be used as the liquid material. A low carbon steel rod of 0.5" diameter was used as the solid component. The steel insert was placed in a graphite mold with a cavity of 2" diameter and 4" tall before the molten aluminum was poured on top of the insert. FIG. 7 illustrates the dimensions of the composite casting where the small bar represents the steel insert and the large bar represents the aluminum casting. FIG. 8 shows a photograph of the composite casting of which the small bar is the steel insert and the white part is the aluminum alloy. The external field used for this example was a small amplitude vibration at 20 kHz of up to 1.5 kW with maximum amplitude of 84 micron meters. The steel insert was bolted on the vibrator at one end so that the vibration was transmitted to the other end which was in contact with the molten aluminum. A systematic study was carried by varying the pouring temperature of the molten metal at temperatures between 650° C. and 750° C., and the amplitude of vibration between 0 and 84 micron meters. Specimens were cut using a bench saw from the composite casting shown in FIG. 8. These specimens were then used for characterizing the microstructure of the bond, and its mechanical properties using a push-out testing method [9]. Because there was no metallurgical bond between the steel insert and the aluminum casting, the insert in specimen made using conventional cast-on method dropped off the aluminum casting, shown in FIG. 9A. The insert in the specimen made using the bonding method of the present invention remained. No gap formation was found at the interface between the insert and the aluminum casting on the as-cut surface shown in FIG. 9B and the polished surface shown in FIG. 9C, indicating at least that an intimate bond was obtained using the bonding technology of the present invention.

Figure 10A:
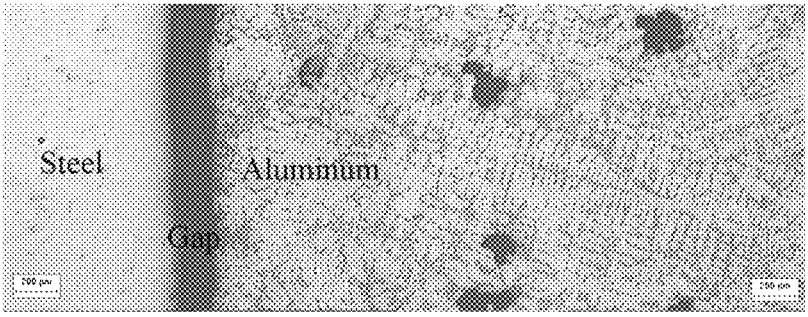
FIG. 10A is a micrograph of a defective bond.
Figure 10B:
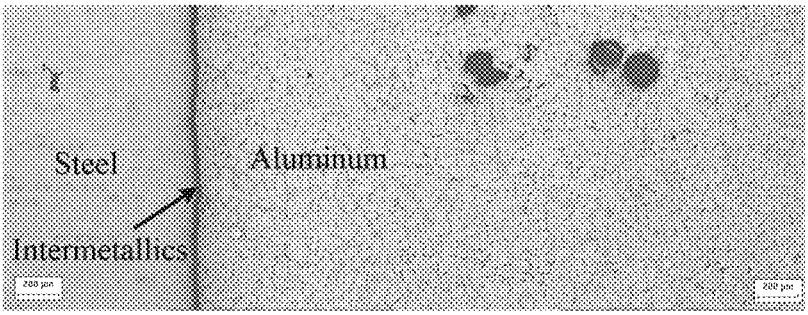
FIG. 10B is micrograph of a perfect bond.
Figure 10C:
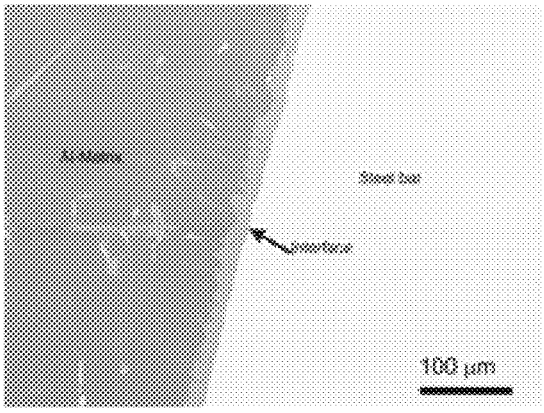
FIG. 10C is a SEM image showing the intermetallic phases of the metallurgical bond.

The polished specimens were etched to reveal the quality of the bond. FIG. 10A shows the microstructure near the steel/aluminum interface made using the conventional cast-on method. A gap exists between the steel and aluminum, indicating that no metallurgical bond was formed. At the right-hand side of the gap, the primary dendrites of the aluminum-rich fcc phase are columnar, and their lengths are longer than 1000 micron meters. This is an indication that the aluminum grain size is much larger than 1000 micron meters since each grain contains six primary dendrites. FIG. 10B shows the microstructure near the bond made using this bonding technology of this invention. An intimate contact between steel and aluminum is observed. The bond is shown as a dark line under optical microscope. The SEM image of this dark line, shown in FIG. 10C, reveals that the dark line consists of iron-aluminides which are the reaction products of molten aluminum with iron at the steel/aluminum interface. No defects such as pores and oxide particles are found in FIG. 10B and FIG. 10C near the bond. It is evident that defect-free metallurgical bonds are obtained using the bonding technology of the present invention in this example. Furthermore, small and equiaxed aluminum grains are formed near the bond obtained using the present invention. The grain size shown in the aluminum side in FIG. 10B is much smaller than that shown in FIG. 10A. It is well known that the mechanical properties of an aluminum alloy having small equiaxed grains are much better than those with large columnar grains.

Push-out tests were performed to measure the mechanical properties of the bond in the composite casting. The inserts on the specimens shown in FIGS. 9A, 9B, and 9C were pushed out from the aluminum using a steel punch on a tensile testing machine. The maximum shear stress required to push out the steel insert from the aluminum was in the range of about 7.0 to about 2133 psi for the specimens made using the conventional cast-on method but was in the range of about 10,766 to about 14,569 psi for the specimens made using the present invention. This result indicates that the bond technology of the present invention is capable of producing bonding strength more than 6 times higher than the conventional cast-on method under identical casting conditions. It is worth noting that 12,000 psi is actually the shear strength of the aluminum A354 alloy under as-cast conditions.

Example 2

Figure 11:
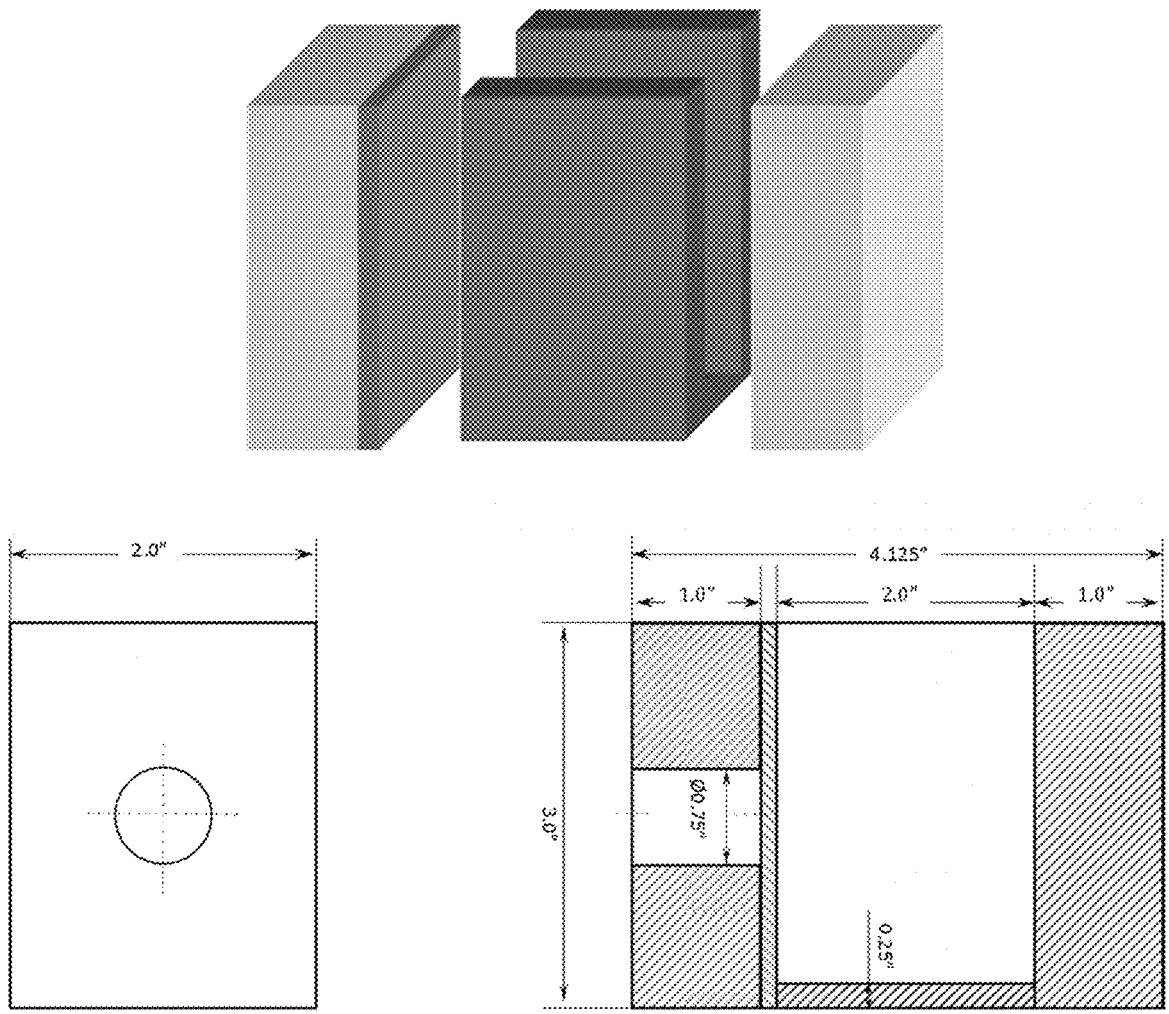
FIG. 11 is schematic illustration of the molds and a thin liner in green color.
Figure 12:
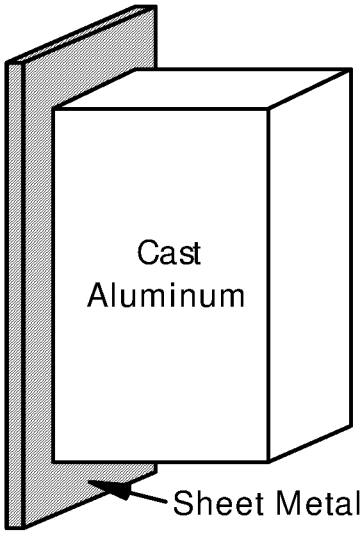
FIG. 12 is schematic illustration of a composite casting with the sheet metal bonded to the aluminum casting.

This example was designed to demonstrate that the approach shown in FIG. 4 of this invention is capable of producing strong metallurgical bonds between a liner of steel sheet metal and aluminum casting. Molten aluminum A356 alloy was used as the liquid material. The liquidus of the alloy is 616° C. [18]. The pouring temperature in this example was higher than the liquidus of the alloy. Low carbon steel sheet metal was used as the thin liner, or the solid component. Both plain sheet metal and Zn-coated sheet metal were tested. The sheet metal was used to form one side wall of the cavity. The walls on the other side of the cavity were formed using steel molds shown in FIG. 11. Upon pouring the liquid material to the cavity in the molds, the liquid material contacted and reacted with the sheet metal to form a metallurgical bond. Composite castings, each consisting of the sheet metal and the cast aluminum shown in FIG. 12, were made using such molds.

Tests using the conventional cast-on method and the present invention were performed. The external field used for this example was small amplitude acoustic vibrations. The tip of the vibrator was applied on the back side of the liner of steel sheet metal through the ¾" hole on the left side of the mold shown in FIG. 11. The vibration at the tip of the vibrator was coupled to the back side of the sheet metal by using either screwed connection, magnetic connection, or a fluid such as water, oil, silicone, or UV gel. The fluid served both as a coupling agent to the vibrations and as a coolant to cause local progressive solidification from the liner. The power of the vibrator was 1.5 kW with a maximum amplitude of 84 micron meters. The frequency was 20 kHz.

Figure 13:
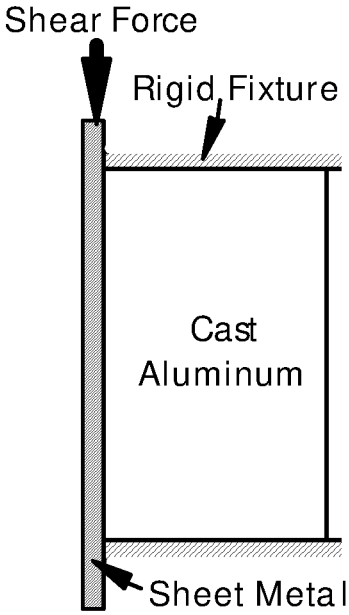
FIG. 13 is a schematic illustration showing the setup for measuring the sheer force required to separate the sheet metal from the aluminum casting.
Figure 14:
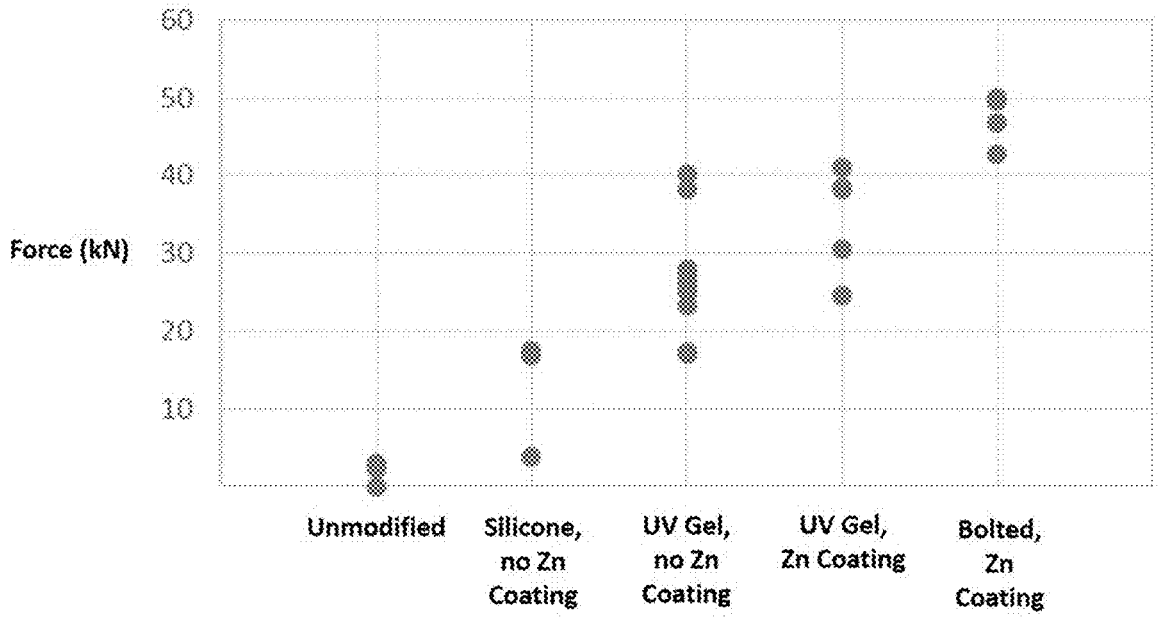
FIG. 14 is a graph of data showing the shear force vs. experimental conditions.
Figure 15:
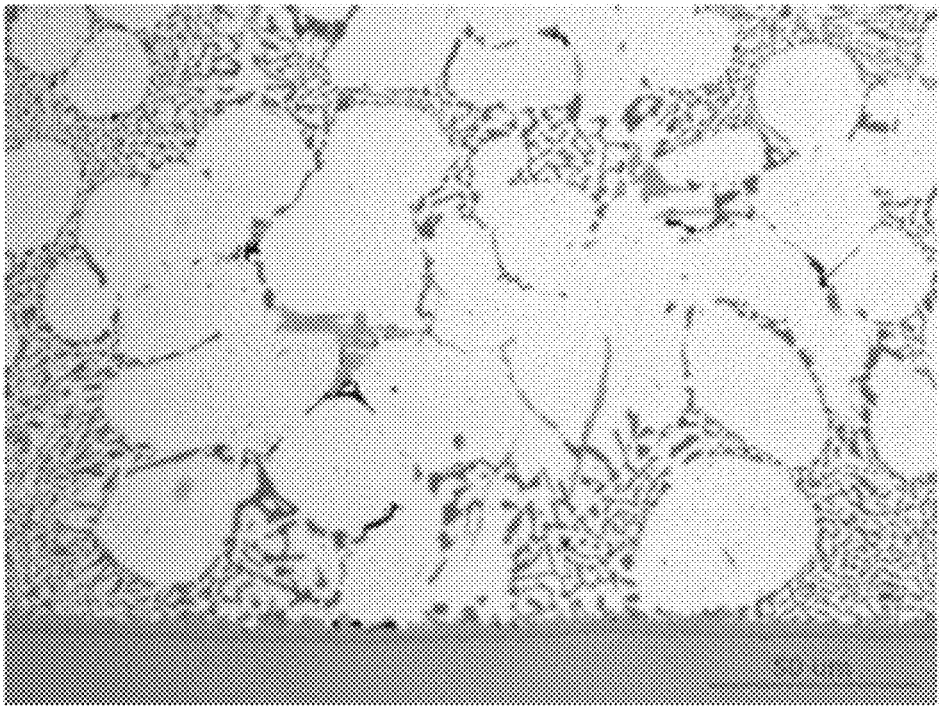
FIG. 15 is a micrograph of a perfect metallurgical bond between sheet metal (bottom) and aluminum casting (top) with a gray layer of intermetallic phases formed at the interface between the sheet metal and the aluminum material.

Composite castings made using the conventional cast-on method were defective at the interface between the sheet metal and the aluminum alloy. The sheet metal was not able to be bonded to the aluminum alloy cast in the mold cavity. Composite castings with high quality metallurgical bonds were successfully made using the new bonding technology of the present invention. To determine the strength of the metallurgical bond between the steel sheet metal and the aluminum casting, a shear test setup to separate the two materials was designed. The shear test held the aluminum part of the casting, while the machine's crosshead exerted a downward force on the edge of the sheet metal to separate it from the aluminum. The force required for separation was recorded. A schematic illustration of the shear test setup is shown in FIG. 13. The measured shear force vs. test conditions was plotted in FIG. 14. The unmodified condition in FIG. 14 refers to the conventional cast-on method. The other conditions in FIG. 14 relate to the use of the bonding technology of the present invention with the external field coupled to the sheet metal using silicone, UV Gel, or bolted connections. Steel sheet metal with or without Zn coating were tested. As shown in FIG. 14, the sheer force required to separate the sheet metal from the aluminum is much higher using the bonding technology of the present invention than that using the conventional cast-on method. It is evident that the new technology of the present invention produces a metallurgical bond that is much stronger than that produced using the conventional cast-on methods. FIG. 15 shows the microstructure of the specimen produced using the present invention. A layer of intermetallic phases is formed between the steel sheet metal and the aluminum alloy. The formation of such a clean layer of intermetallic phases at the steel/aluminum interface is strong evidence that a high quality metallurgical bond is formed in the composite casting.

While the invention has been described in connection with specific embodiments thereof, it will be understood that the inventive methodology is capable of further modifications. This patent application is intended to cover any variations, uses, or adaptations of the invention following, in general, the principles of the invention and including such departures from the present disclosure as come within known or customary practice within the art to which the invention pertains and as may be applied to the essential features herein before set forth and as follows in scope of the appended claims.

REFERENCES

1. Q. Han, and J. Zhang, "Fluidity of Alloys under High-Pressure Die Casting Conditions: Flow-Choking Mechanisms," Metallurgical and Materials Transactions B, vol. 51, 2020, to be published.
2. M. G. Whitfield, "Al-Fin Process Bonds Aluminum to Steel," Auto & Aviation Industries, vol. 90, No. 6, 1944, p 148, 212-3.
3. M. G. Whitfield, and V. Sheshunoff, "Aluminum Bonded to Steel or Cast Iron," Matls & Methods, vol. 22, No. 4, 1945, pp. 1090-6.
4. M. G. Whitfield, and V. Sheshunoff, (1946), "Bonding Aluminum to Steel or Cast Iron," Metal Treatment, vol. 8, pp. 70-6.
5. T. Weissmann, "Bimetallics Offers Best of Both Worlds," Design Engineering, Vol. 9, No. 8, 1963, pp. 42-3.
6. H. W. Crusey, "Magnesium-Ferrous Castings Solve Design Problems," Materials & Methods, vol. 41, No. 5, 1955, pp. 114-5.
7. J. H. Beile, and C. H. Lund, "Current Status of Composite Casting as Bonding Technique," Metals Engineering Quarterly, No. 1, 1966, pp. 63-4.
8. "Bonding Iron to Aluminum by Cast-On," Light Metals, vol. 21, No.248, 1958, pp. 355-6.
9. Q. Han, "A Modified Cast-on Method for the Reinforcement of Aluminum Castings with Dissimilar Metals," Metallurgical and Materials Transactions B, vol. 47, 2016, pp. 3266-3273.
10. Q. Han, "Motion of bubbles in the Mushy Zone," Scripta Materialia, vol. 55, 2006, pp. 871-874.
11. Q. Han, G. Ludtka, and Q. Zhai, "Materials Processing under the Influence of External Fields," Proceeding of a Symposia Sponsored by TMS (The Minerals, Metals & Materials Society), TMS Annual Meeting, 2007.
12. M. C. Flemings, "Behavior of Metal Alloys in the Semisolid State," Metallurgical Transaction B, vol. 22, 1991, pp. 269-293.
13. M. Rakita, and Q. Han, "Influence of Pressure Fields in Melts on the Primary Nucleation in Solidification Processing," Metallurgical and Materials Transactions B, vol. 48, 2015, pp. 2232-2244.
14. L. Han, C. Vian, J. Song, Z. Liu, Q. Han, C. Xu, and L. Shao, "Grain Refining of Pure Aluminum," Light Metals, 2012, pp. 967-971.
15. Y. Zhang, X. Miao, Z. Shen, Q. Han, C. Song, and Q. Zhai, "Macro Segregation Formation Mechanism of the Primary Silicon Phase in Directionally Solidified Al—Si Hypereutectic Alloys under the Impact of Electric Currents," Acta Materialia, vol. 97, 2015, pp. 457-366.
16. Y. Zhang, C. Song, L. Zhu, H. Zheng, Q. Han, and Q. Zhai, "Influence of Electric-Current Pulse Treatment on the Formation of Regular Eutectic Morphology in an Al—Si Eutectic Alloy," Metallurgical and Materials Transactions B, vol. 42, 2011, pp. 604-611.
17. C. Song, Y. Guo, Y. Zhang, H. Zheng, M. Yan, Q. Han, and Q. Zhai, "Effect of Currents on the Microstructure of Directionally Solidified Al-4.5 wt % Cu Alloy," Journal of Crystal Growth, vol. 324, 2011, pp. 235-242.
18. Q. Han, and S. Wiswanathan, "The Use of Thermodynamic Simulation for the Selection of Hypoeutectic Aluminum-Silicon Alloys for Semi-Solid Metal Processing," Materials Science and Engineering A, vol. 364, 2004, pp. 48-54.

What is claimed is:

1. A method of producing acceptable quality metallurgical bonds within a composite casting, the method comprising the steps of:

placing at least one solid insert or component of similar or dissimilar material to a freezable material at least partially in a mold cavity;

introducing a freezable liquid material to contact the at least one solid component at the interfaces between the at least one solid component and the liquid material in the mold cavity;

applying external fields to generate local stirring in the liquid material near the said interfaces for a duration of time to wash or shake off bubbles and oxide particles that attach to the said interfaces;

producing local progressive solidification from the said interfaces to the liquid material to drive bubbles away from interfaces under influence of external fields; and solidifying the liquid material to produce a solid composite article comprising the solidified liquid material and the at least one solid component.

2. A method of claim 1, wherein the freezable liquid material is a liquid or slurry containing fractions of solid less than 0.2.

3. A method of claim 1, wherein the said at least one solid component comprise of metallic materials or ceramic materials and each solid component consists of its own composition and microstructure dissimilar to the liquid material.

4. A method of claim 1, wherein the said at least one solid component comprises of metallic or ceramic materials with or without a coating wherein the coating includes plating, hot dipping, spraying, laser printing, or bonded lining materials.

5. A method of claim 1, wherein the external fields include alternating or pulsed fields.

6. A method of claim 5, wherein the alternating or pulsed fields include electric, magnetic, electromagnetic Lorentz forces, mechanical forces, acoustic vibration, low magnitude mechanical vibration, or a combination of these external fields.

7. A method of claim 6, wherein the acoustic vibration is coupled to the said at least one solid component by using either screwed connection, magnetic connection, or a fluid such as water, oil, silicone, or a UV gel.

8. A method of claim 1, wherein one of the external fields is a mechanical or acoustic vibration with an amplitude smaller than 100 micrometers, at a frequency between about 50 Hz and about 200 kHz, at a power level between about 10 watts and about 60,000 watts.

9. A method of claim 1, wherein one of the external fields is a mechanical or acoustic vibration with an amplitude smaller than 100 micrometers, at a frequency between about 15 kHz and about 60 kHz, at a power level greater than 100 watts to cause cavitation in the liquid material near the said interface.

10. A method of claim 1, wherein the said external field is an electromagnetic field with a frequency in the range of about 40 Hz to 10 kHz and a power level up to 300,000 watts to generate forced stirring in the liquid material near the said interfaces.

11. A method of claim 1, wherein the said external field is a pulsed magnetic oscillation with a frequency in the range of about 0.1 Hz to 10 Hz and a power level up to 300,000 watts to generate forced stirring in the liquid material near the said interfaces.

12. A method of claim 1, wherein the one of the said external fields is a pulsed electrical current with a frequency in the range of about 50 Hz to 1000 Hz and current density in the range of about 5 $A/mm^2$ to about 50 $A/mm^2$.

13. A method of claim 1, wherein the said local progressive solidification from the said interfaces to the liquid material is maintained for at least a distance above which existence of porosity and oxides doesn't affect performance of bonding joining the solidified liquid materials cast on the said at least one solid component.

14. A method of claim 1, wherein the said local progressive solidification is caused by cooling of the said at least one solid component using a coolant, including air, water, or a liquid coupling the said external fields to the said at least one solid component.

15. A method of claim 1, wherein the method is part of a process selected from the group consisting of casting, coating, 3D-printing, or spray forming.

16. A method of claim 1, wherein the introducing step comprises forming a layer of the liquid material over the said at least one solid component.

* * * * *